US005443935A

United States Patent [19]

Kojima et al.

[11] Patent Number: 5,443,935

[45] Date of Patent: Aug. 22, 1995

[54] ELECTROPHOTOGRAPHIC PHOTORECEPTOR

[75] Inventors: Takashi Kojima; Shinichi Suzuki; Yasuyuki Shigematsu, all of Ibaraki, Japan

[73] Assignee: Mitsubishi Petrochemical Co., Ltd., Tokyo, Japan

[21] Appl. No.: 54,087

[22] Filed: Apr. 30, 1993

[30] Foreign Application Priority Data

May 11, 1992 [JP] Japan ..... 4-117585

[51] Int. Cl.[6] ..... G03G 5/06; G03G 5/05

[52] U.S. Cl. ..... 430/78; 430/96

[58] Field of Search ..... 430/78, 96

[56] References Cited

U.S. PATENT DOCUMENTS

| | | | |
|---|---|---|---|
| 4,443,528 | 4/1984 | Tamura et al. | 430/78 |
| 4,642,280 | 2/1987 | Ueda . | |
| 5,106,536 | 4/1992 | Miyamoto et al. | 430/78 |
| 5,112,711 | 5/1992 | Nguyen et al. | 430/78 |
| 5,166,025 | 11/1992 | Kaieda et al. | 430/78 |
| 5,266,431 | 11/1993 | Mammino et al. | 430/96 |
| 5,283,146 | 2/1994 | Ohashi et al. | 430/78 |

FOREIGN PATENT DOCUMENTS

| | | |
|---|---|---|
| 0460615 | 12/1991 | European Pat. Off. . |
| 0524476 | 1/1993 | European Pat. Off. . |
| 3311485 | 9/1983 | Germany . |
| 3421969 | 12/1984 | Germany . |
| 59-188655 | 10/1984 | Japan . |
| 2145835 | 4/1985 | United Kingdom . |

OTHER PUBLICATIONS

Database WPI, Derwent Publications Ltd., AN 90-302935 (40), JP-A-2 215 866, Aug. 28, 1990.

*Primary Examiner*—Christopher D. Rodee

*Attorney, Agent, or Firm*—Oblon, Spivak, McClelland, Maier & Neustadt

[57] ABSTRACT

An electrophotographic photoreceptor comprising a conductive substrate having thereon a photosensitive layer comprising a binder resin having dispersed therein a phthalocyanine composition is disclosed, in which said binder resin is a curing fluorine resin, and said phthalocyanine composition comprises (A) an unsubstituted phthalocyanine compound and (B) a phthalocyanine derivative having a halogen atom(s) and/or electron attractive group(s) at the benzene nuclei, such that the ratio of the number of the halogen atom(s) and/or electron attractive group(s) to the total number of the phthalocyanine units in (A) and (B) is from 0.001 to 0.5. The photoreceptor has a low threshold value of photosensitive characteristics and exhibits high sensitivity in a digital behavior. Besides applicable to a digital recording system, the photoreceptor, when applied to a conventional PPC system, provides a sharp-edged high quality image.

10 Claims, 1 Drawing Sheet

ELECTROPHOTOGRAPHIC PHOTORECEPTOR

FIELD OF THE INVENTION

This invention relates to an electrophotographic photoreceptor for digital signal input.

BACKGROUND OF THE INVENTION

Conventional electrophotographic photoreceptors include those which are close to a simple photoconductor, so-called Karlson's photoreceptors, those having an amorphous Se photosensitive layer, those having an amorphous Si layer, and ZnO-resin photoconductors which are designed after the amorphous Se layer. A photosensitive layer of separate function type using an organic semiconductor has lately been used. Since these electrophotographic techniques have been developed as a means for an analogue recording system, the photoconductive material to be used has been selected so as to cause a photoelectric current in proportion to the amount of incident light. For this reason, photoreceptors comprising amorphous Se are widely spread.

With the recent advancement of computer communication techniques combined with electrophotographic techniques, an electrophotographic recording system has rapidly been introduced into a printer system or a facsimile system. Accordingly, it has been demanded to displace the conventional analogue recording system for plain paper copiers (PPC) with a digital recording system in the field of electrophotography.

Photoreceptors exhibiting an analog behavior which have conventionally been used in electrophotography are by nature wholly unsuited to electrophotography requiring a digital recording system, such as a computer for information or image processing by digitization.

JP-A-1-16954 (the term "JP-A" as used herein means an "unexamined published Japanese patent application") discloses the use of a photoreceptor for digital light input which exhibits photosensitive characteristics with a threshold value. However, the energy value of the photoreceptor proposed at the threshold value is too high for practical application.

SUMMARY OF THE INVENTION

An object of the present invention is to provide an electrophotographic photoreceptor which exhibits a digital behavior against incident light with a low threshold energy value and is applicable to digital exposure to semiconductor laser light, etc.

The present invention relates to an electrophotographic photoreceptor comprising a conductive substrate having thereon a photosensitive layer comprising a binder resin having dispersed therein a phthalocyanine composition, in which said binder resin is a curable fluorine resin, and said phthalocyanine composition comprises (A) an unsubstituted phthalocyanine compound represented by formula (I):

(I)

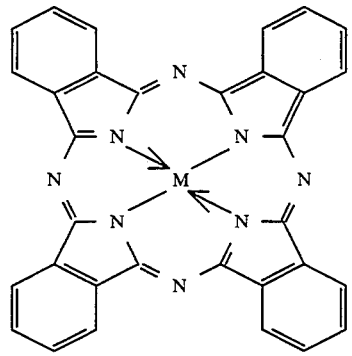

wherein M represents a hydrogen atom or an atom or compound residue capable of covalent bonding or coordinate bonding to the phthalocyanine ring, and (B) a phthalocyanine derivative represented by formula (II):

(II)

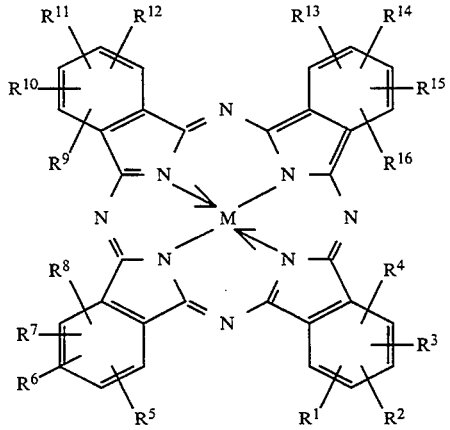

wherein M is as defined above; and $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, and $R^{16}$, which may be the same or different, each represent a hydrogen atom, a halogen atom or an electron attractive group, provided that at least one of them represents a halogen atom or an electron attractive group, such that the ratio of the number of the halogen atom(s) and/or electron attractive group(s) to the total number of the phthalocyanine units in the unsubstituted phthalocyanine compound (A) and the phthalocyanine derivative (B) is from 0.001 to 0.5.

DETAILED DESCRIPTION OF THE INVENTION

Figure 1:
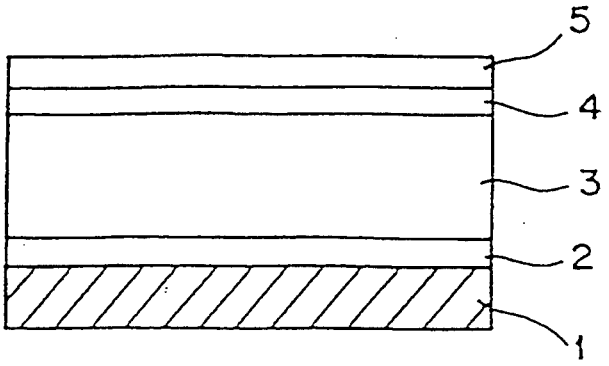
FIG. 1 is a schematic cross section illustrating an example of the layer structure of an electrophotographic photoreceptor according to the present invention.

The curable fluorine resin which can be used as a binder resin in the present invention is a polymer having fluorine atoms and functional groups reactive to a cross-linking agent and generally includes copolymers obtained from (a) an ethylenically unsaturated monomer having fluorine atoms and (b) an ethylenically unsaturated monomer having no fluorine atom. The number-average molecular weight of the curable fluorine resin preferably ranges approximately from 5,000 to 200,000.

Examples of the fluorine-containing ethylenically unsaturated monomer (a) include fluorine-containing olefins, such as tetrafluoroethylene, trifluoroethylene, vinylidene fluoride, vinyl fluoride, monochlorotrifluoroethylene, 1-chloro-2,2-difluoroethylene, 1,1-dichloro-2,2-difluoroethylene, vinylidene chlorofluoride, hexafluoropropene, 3,3,3,2-tetrafluoropropene, trifluorofluoromethylethylene, 2-fluoropropene, 2-chloro-1,1,3,3,3-pentafluoropropene, 1,1,2-trichloro-3-trifluoropropene, perfluoro-1-butene, perfluoro-1-pentene, perfluorobutylethylene, perfluoro-1-heptene, perfluoro-1-nonene, perfluorohexylethylene, perfluorooctylethylene, perfluorodecylethylene, and perfluorododecylethylene; fluorinated alkyl vinyl ethers (alkyl vinyl ethers with a part or the whole of the hydrogen atoms thereof substituted with a fluorine atom); and fluorinated fatty acid vinyl esters (fatty acid vinyl esters with a part or the whole of the hydrogen atoms thereof substituted with a fluorine atom).

The ethylenically unsaturated monomer (b) having no fluorine atom should have a functional group reactive to a crosslinking agent or a group into which such a functional group can be introduced. The functional group reactive to a crosslinking agent includes a hydroxyl group, a carboxyl group, an acid anhydride group, an amino group, and a glycidyl group.

Examples of the ethylenically unsaturated monomer (b) having no fluorine atom and having the above-mentioned functional group are glycidyl vinyl ethers, hydroxyalkyl vinyl ethers, hydroxyalkyl allyl ethers, allyl alcohol, hydroxyalkyl (meth)acrylates, acrylic acid, and methacrylic acid.

Examples of the ethylenically unsaturated monomer (b) having no fluorine atom and having a group into which the above-mentioned functional group can be introduced are vinyl esters and allyl esters.

In addition to these ethylenically unsaturated monomers, the fluorine resin may contain other copolymerizable monomers for adjusting physical characteristics of the fluorine resin. Examples thereof include ethylene, propylene, isobutylene, vinyl esters, vinyl chloride, vinylidene chloride, ethyl vinyl ether, isobutyl vinyl ether, n-butyl vinyl ether, and other vinyl ethers. These other copolymerizable monomers are used in a proportion of not more than 95 mol %, preferably from 3 to 85 mol %, and more preferably from 5 to 75 mol %, based on the total amount of the other copolymerizable monomers and the ethylenically unsaturated monomer (b) containing no fluorine atom.

A preferred curable fluorine resin is a copolymer containing from 25 to 75 mol % of the unit derived from the fluorine-containing ethylenically unsaturated monomer (a), and particularly a fluorine-containing olefin monomer. An ethylenically unsaturated monomer (b) having no fluorine atom to be copolymerized with the fluorine-containing olefin monomer (a) is preferably selected from vinyl ethers and vinyl esters having a functional group reactive to a crosslinking agent. In particular, a copolymer obtained from hydroxyl-containing ethylenically unsaturated monomers is more preferred.

Such curable fluorine-resins are commercially available under trade names "CEFRAL COAT" (sold by Central Glass Co., Ltd.) and "Lumiflon" (sold by Asahi Glass Co., Ltd.).

Crosslinking agents which can be used for crosslinking curing of the curable fluorine resins include compounds having more than one active groups, such as butylated melamine, methylated melamine, polyisocyanate compounds, and glyoxal.

Curing of the curable fluorine resin is generally effected, as hereinafter described, by dissolving the fluorine resin and the phthalocyanine composition in an appropriate solvent, mixing the solution with a crosslinking agent, and coating the resulting coating composition on a substrate, followed by drying. If desired, an antioxidant may be added to the coating composition.

The crosslinking agent is usually used in an equivalent amount or in excess in terms of the functional groups thereof.

In formulae (I) and (II), M includes a hydrogen atom, copper, nickel, cobalt, tin, zinc, iron, lead, magnesium, vanadium, titanium, a residue of an oxide or halide of these metals, and mixtures thereof. Preferred examples include a hydrogen atom, Cu, Mg, VO and TiO.

Phthalocyanine compounds (A) are well known as pigments. Either crude phthalocyanine or phthalocyanine suited as a pigment may be employed.

The phthalocyanine derivatives (B) represented by formula (II) are phthalocyanine compounds with its benzene nucleus (or nuclei) substituted with a halogen atom or an electron attractive group. The halogen atom preferably includes a chlorine atom and a bromine atom. The electron attractive group preferably includes a nitro group, a cyano group, a carboxyl group, and a sulfo group.

The phthalocyanine derivatives of formula (II) can be prepared by any known processes for synthesizing phthlaocyanine compounds without particular limitation, except for using any one of or a combination of phthalonitrile, phthalic acid, phthalic anhydride and phthalimide each of which is substituted with the above-mentioned substituent. The phthalocyanine derivative preferably carries from 1 to 16, and preferably from 1 to 6, halogen atoms or electron attractive groups per molecule.

The phthalocyanine composition which can be used in the present invention comprises the unsubstituted phthalocyanine compound of formula (I) and the phthalocyanine derivative of formula (II) such that the ratio of the number of the halogen atom(s) and/or electron attractive group(s) to the total number of the phthalocyanine units in the unsubstituted phthalocyanine compound and the phthalocyanine derivative is from 0.001 to 0.5, and preferably from 0.002 to 0.2.

A preferred phthalocyanine composition comprises 100 parts by weight of the unsubstituted phthalocyanine compound and from 0.001 to 8 parts by weight of the phthalocyanine derivative having 1 to 6 halogen atom(s) and/or electron attractive group(s).

A more preferred phthalocyanine composition comprises 100 parts by weight of the unsubstituted phthalocyanine compound, from 0.001 to 3 parts by weight of the phthalocyanine derivative having 1 to 3 halogen atom(s) and/or electron attractive group(s), and from 0.01 to 8 parts, preferably from 0.1 to 5, by weight of the phthalocyanine derivative having 4 to 6 halogen atom(s) and/or electron attractive group(s), provided that the number of the halogen atom(s) and/or electron attractive group(s) satisfies the above-mentioned range.

The phthalocyanine composition of the present invention can be prepared by dissolving the unsubstituted phthalocyanine and the phthalocyanine derivative at the above-mentioned ratio in an acid and re-precipitating the composition by adding a poor solvent.

Examples of the acid to be used in the above-mentioned process include inorganic acids, e.g., sulfuric acid, orthophosphoric acid, hydrochloric acid, chlorosulfonic acid, hydroiodic acid, hydrofluoric acid, and hydrobromic acid; and organic acids, such as alkylsulfonic acids (e.g., methanesulfonic acid, ethanesulfonic acid, propanesulfonic acid), halogenated alkylsulfonic acids, and halogenated alkylcarboxylic acids (e.g., trifluoromethylcarboxylic acid). The organic acids are preferable. A mixed acid composed of an aromatic organic acid (e.g., toluenesulfonic acid, benzenesulfonic acid, toluenecarboxylic acid, and benzenecarboxylic acid) and at least one of the above-mentioned aliphatic organic acids, i.e., alkylsulfonic acids, halogenated alkylsulfonic acids and halogenated alkylcarboxylic acids, may also be used. In this case, the aromatic organic acid is preferably used in an amount of from 1 to 6 parts by weight, and more preferably from 1 to 4 parts by weight, per 10 parts by weight of the aliphatic organic acid. The aromatic organic acid, if used in an amount exceeding 6 parts by weight, is not uniformly dissolved in the aliphatic organic acid.

The acid is preferably used in an amount of from 5 to 30 parts by weight, and more preferably from 10 to 20 parts by weight, per part by weight in total of the unsubstituted phthalocyanine and the phthalocyanine derivative.

The unsubstituted phthalocyanine and the phthalocyanine derivative are dissolved in the above-described acid with thorough stirring, preferably at a temperature of from 0° to 30° C. The stirring time is preferably from 0.5 to 3 hours.

The poor solvent for re-precipitation is not particularly limited as long as phthalocyanine is insoluble therein. Water is a preferred poor solvent. Besides water, methanol, ethanol, acetone or methyl ethyl ketone is also preferred. The poor solvent is preferably used in an amount 3 to 30 times, and more preferably from 5 to 15 times, the volume of the acid used.

Re-precipitation is carried out by, for example, transferring the acid solution in a dropping funnel and slowly adding the solution into a poor solvent, such as water, with thorough stirring. The poor solvent is preferably kept at a temperature of from 0° to 20° C. After the dropwise addition, the stirring is continued for a while, preferably from 0.5 to 3 hours. The thus precipitated phthalocyanine composition is collected by filtration, washed with water, and dried.

A weight ratio of the phthalocyanine composition and the fluorine resin binder ranges from 5:95 to 50:50, and preferably from 10:90 to 40:60.

According as the ratio of the phthalocyanine composition increases, the resulting photoreceptor has a lower threshold value for photosensitive characteristics and increased photosensitivity, but the charging properties of the photoreceptor would be reduced. On the other hand, as the ratio of the phthalocyanine composition decreases, the threshold value of the photosensitive characteristics becomes high, and the photosensitivity is insufficient for practical use.

The terminology "photosensitive characteristics" of a photoreceptor as used herein means dependency of the surface potential of the photoreceptor on exposure energy. The terminology "photosensitivity" as used herein means the maximum of the exposure energy with which the initial surface potential can be maintained at substantially the same level.

The phthalocyanine composition and the fluorine resin binder are dissolved in a solvent, and, if desired, necessary additives, such as a curing agent, a catalyst, and an antioxidant, are uniformly dispersed therein to prepare a coating composition. There is no limitation with respect to the solvent, as long as the curable fluorine resin can be dissolved in the solvent. Examples of the solvent include alcohols such as methanol, ethanol and isopropanol; ketones such as acetone, methylethylketone and cyclohexanone; amides such as N,N-dimethylformamide and N,N-dimethylacetoamide; sulfoxides such as dimethylsulfoxide; ethers such as tetrahydrofuran, dioxane and ethylene glycol monomethylether; esters such as methyl acetate and ethyl acetate; aliphatic halogenated hydrocarbons such as chloroform, methylene chloride dichloroethylene, carbon tetrachloride and trichloroethylene; and aromatic hydrocarbons such as benzene, toluene, xylene, ligroin, monochlorobenzene and dichlorobenzene. The coating composition is coated on a conductive substrate followed by drying to provide an electrophotographic photoreceptor according to the present invention.

The photoreceptor is basically composed of conductive substrate (1) having formed thereon photosensitive layer (3). If desired, subbing layer (2), intermediate layer (4), protective layer (5), and the like may also be provided as shown in FIG. 1.

The conductive substrate includes a plate or drum made of a metal, and a paper sheet or plastic film having been rendered electrically conductive by forming thereon a conductive thin layer comprising a conductive compound (e.g., a conductive polymer or indium oxide) or a metal (e.g., aluminum, palladium or gold) by coating, vacuum deposition or laminating. A substrate comprising a binder resin having dispersed therein carbon, a metal powder, etc. can also be used.

Coating of the photosensitive layer can be carried out by dip coating, spray coating, spinner coating, bead coating, wire bar coating, blade coating, roller coating, curtain coating or the like coating technique.

After being coated, the coating film is preferably preliminarily dried at room temperature, followed by curing by heating at 30° to 300° C. for 1 minute to 6 hours either in still air or in an air flow. Heat drying may be effected in an inert gas or in vacuo. Heat drying may also be effected under heating conditions varied in multiple stages.

The photosensitive layer preferably has a thickness of from 5 to 50 μm, and more preferably from 10 to 30 μm.

The present invention is now illustrated in greater detail with reference to Examples, but it should be understood that the present invention is not construed as being limited thereto. All the percents are by weight unless otherwise indicated.

EXAMPLES

Preparation of Phthalocyanine Composition:

To 440 g of methanesulfonic acid were dissolved 40 g of copper phthalocyanine containing 0.005% of monochlorocopper phthalocyanine and 0.8 g of tetranitrocopper phthalocyanine while thoroughly stirring, and the solution was poured into 2000 g of water to precipitate a phthalocyanine composition. The precipitate thus formed was collected by filtration, washed with water and dried at 60° C. to obtain 39.8 g of a phthalocyanine composition A having the following composition:

| | |
|---|---|
| Copper phthalocyanine | 98.0% |
| Monochlorocopper phthalocyanine | 0.01% |
| Tetranitrocopper phthalocyanine | 1.96% |
| Halogen + electron attractive group/ phthalocyanine unit (molar ratio) | 0.060 |

EXAMPLE 1

| | |
|---|---|
| Phthalocyanine composition A | 1.37 g |
| Binder resin: | 6.0 g |
| Fluorine resin "CEFRAL COAT A-101B" (fluoroethylene/fatty acid vinyl ester/hydroxyl-containing allyl ether copolymer, produced by Central Glass Co., Ltd.) | |
| Curing Agent: | 0.84 g |
| Melamine resin "Nikalac MW-30" (produced by Sanwa Chemical Co., Ltd.) | |
| Antioxidant: | 55 mg |
| "Irganox 1035" (produced by Chiba Geigy) | |
| Solvent: Cyclohexanone | 25 g |

The above components were sealed into a glass container together with glass beads having a diameter of 2 mm, and the mixture was dispersed in a paint mixer for 4 hours to prepare a coating composition having a viscosity of 122 cps (at 20° C.).

The coating composition was coated on a 90 μm thick aluminum sheet having been subjected to degreasing with a wire bar, preliminarily dried at room temperature, and heated in an oven at 80° C. for 1 hour and then at 200° C. for 10 minutes to obtain an electrophotographic photoreceptor having a photosensitive layer having a thickness of 17 μm.

EXAMPLE 2

The same components as used in Example 1, except for replacing the binder resin as used in Example 1 with a fluorine resin of different grade ("CEFRAL COAT A-201TB" produced by Central Glass Co., Ltd., having a composition similar to that of "CEFRALCOAT A-101") were used at the following mixing ratio to prepare a coating composition having a viscosity of 75 cps (at 20° C.) in the same manner as in Example 1.

| | |
|---|---|
| Phthalocyanine composition A | 1.08 g |
| Fluorine resin "A-201TB" | 6.0 g |
| Melamine resin "Nikalac MW-30" | 0.25 g |
| Antioxidant "Irganox 1035" | 43 mg |
| Cyclohexanone | 25 g |

An electrophotographic photoreceptor having a 16 μm thick photosensitive layer was prepared by using the above prepared coating composition in the same manner as in Example 1.

EXAMPLE 3

The same components as used in Example 1, except for using isocyanate as a curing agent and dibutyltin dilaurate as a catalyst, were-used at the following mixing ratio to prepare a coating composition having a viscosity of 106 cps (at 20° C.) in the same manner as in Example 1.

| | |
|---|---|
| Phthalocyanine composition A | 1.22 g |
| Fluorine resin "A-101B" | 6.0 g |
| Isocyanate curing agent: | 0.36 g |

-continued

| | |
|---|---|
| "Coronate HX" produced by Nippon Polyurethane Co., Ltd. | |
| Polyurethane dilaurate | |
| Dibutyltin dilaurate 0.12 mg | |
| Cyclohexanone | 25 g |

An electrophotographic photoreceptor having a 17 μm thick photosensitive layer was prepared by using the above prepared coating composition in the same manner as in Example 1.

EXAMPLE 4

The same components as used in Example 3, except for using "CEFRALCOAT A-201TB" as a binder resin, were used at the following mixing ratio to prepare a coating composition having a viscosity of 81 cps (at 20° C.) in the same manner as in Example 1.

| | |
|---|---|
| Phthalocyanine composition A | 1.1 g |
| Fluorine resin "A-201TB" | 6.0 g |
| Isocyanate curing agent: "Coronate HX" | 0.29 g |
| Dibutyltin dilaurate | 0.12 mg |
| Cyclohexanone | 25 g |

An electrophotographic photoreceptor having a 16 μm thick photosensitive layer was prepared by using the above prepared coating composition in the same manner as in Example 1.

EXAMPLE 5

The same components as used in Example 3, except for using a fluorine resin "LF 200" (produced by Asahi Glass Co., Ltd.) as a binder resin, were used at the following mixing ratio to prepare a coating composition having a viscosity of 96 cps (at 20° C.) in the same manner as in Example 1.

| | |
|---|---|
| Phthalocyanine composition A | 1.33 g |
| Fluorine resin "LF 200" | 6.0 g |
| Isocyanate curing agent: "Coronate HX" | 0.39 g |
| Dibutyltin dilaurate | 0.13 mg |
| Cyclohexanone | 27 g |

An electrophotographic photoreceptor having a 16 μm thick photosensitive layer was prepared by using the above prepared coating composition in the same manner as in Example 1.

COMPARATIVE EXAMPLE 1

| | |
|---|---|
| Phthalocyanine composition A | 0.8 g |
| Binder resin: | 11 g |
| Polyester resin "P 645" (produced by Mitsui Toatsu Chemicals Inc.) | |
| Curing Agent: | 3.8 g |
| Melamine resin "20 HS" (produced by Mitsui Toatsu Chemicals Inc.) | |
| Antioxidant "Irganox 1035" | 0.03 mg |
| Cyclohexanone | 3.5 g |
| Ethanol | 1.1 g |

The above components were sealed into a glass container together with 30 g of glass beads and dispersed in a paint mixer for 4 hours to prepare a coating composition having a viscosity of 93 cps (at 20° C.).

The coating composition was coated on an aluminum substrate in the same manner as in Example 1, preliminarily dried at room temperature and then heated in an oven at 200° C. for 3 hours to obtain an .electrophotographic photoreceptor having a 16 μm thick photosensitive layer.

Photosensitive characteristics of the photoreceptors obtained in Examples 1 to 5 and Comparative Example 1 were evaluated as follows by means of a testing apparatus "Cynthia 55" manufactured by Gentec Co.

The photoreceptor was charged to +6.0 kV by corona discharge. The time (sec) at the knee where the surface potential abruptly fell was taken as a dark decay time. The charged photoreceptor was exposed to monochromatic light having a wavelength of 780 nm and a varied intensity to prepare a light decay curve (surface potential vs. exposure time) for every light intensity. The surface potential at the exposure time of 0.5 second was plotted against light energy.

The maximum of the light energy ($E_1$) with which the surface potential was maintained on substantially the same level as the initial surface potential and the minimum of the light energy ($E_2$) with which the surface potential was reduced to around the residual potential (about 30 V) were read out. The $E_2/E_1$ ratio was taken as an indication for applicability to digital recording. According to this method of evaluation, photoreceptors having the $E_2/E_1$ ratio of greater than 0 and smaller than 5 are regarded capable of digital recording, and those having the $E_2/E_1$ ratio of 5 or greater are regarded to be for analogue recording. Where $0<E_2/E_1<5$, the smaller the $E_1$ value, the higher the photosensitivity. The results obtained are shown in Table 1 below.

TABLE 1

| Example No. | $E_1$ (μJ/cm²) | $E_2/E_1$ |
|---|---|---|
| Example 1 | 0.8 | 3.1 |
| Example 2 | 1.3 | 2.1 |
| Example 3 | 2.0 | 3.3 |
| Example 4 | 1.7 | 2.5 |
| Example 5 | 1.3 | 2.8 |
| Comparative Example 1 | 3.2 | 2.1 |

As described above, the electrophotographic photoreceptor according to the present invention, in which a thermosetting fluorine resin is used as a binder resin, has a threshold value with low energy in the photosensitive characteristics and exhibits high sensitivity. Accordingly, the photoreceptors of the present invention is useful for electrophotography of digital recording system. It is also applicable as a substitute for a conventional photoreceptor for PPC (photoreceptor exhibiting an analogue behavior against light input) to provide a high quality image with sharp edges. Additionally, the photoreceptor of the invention exhibits excellent mechanical durability on repeated use and satisfies moisture resistance and printing durability.

While the invention has been described in detail and with reference to specific examples thereof, it will be apparent to one skilled in the art that various changes and modifications can be made therein without departing from the spirit and scope thereof.

What is claimed is:

1. An electrophotographic photoreceptor comprising a conductive substrate having thereon a photosensitive layer comprising a binder resin having dispersed therein a phthalocyanine composition, in which said binder resin is a curable fluorine resin comprising a copolymer of a fluorinated ethylenically unsaturated monomer selected from the group consisting of fluorine-containing olefins, fluorinated alkyl vinyl ethers and fluorinated fatty acid vinyl esters with an ethylenically unsaturated monomer containing no fluorine atoms, and said phthalocyanine composition comprises (A) an unsubstituted phthalocyanine compound represented by formula (Ia) or (Ib):

I(a)

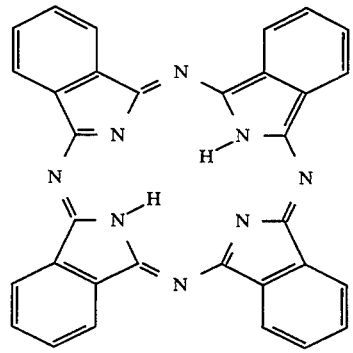

(Ib)

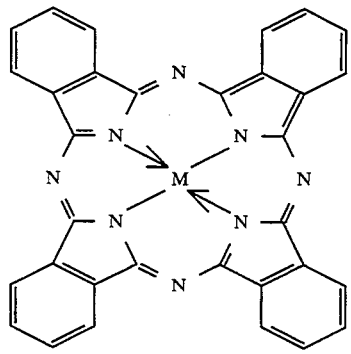

wherein M represents ah atom or compound residue capable of covalent bonding or coordinate bonding to the phthalocyanine ring, and (B) a phthalocyanine derivative represented by formula (IIa) or (IIb):

II(a)

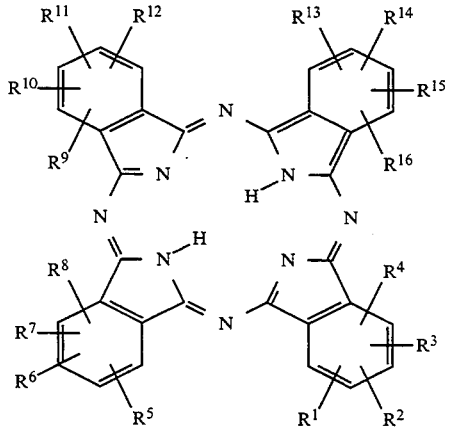

-continued

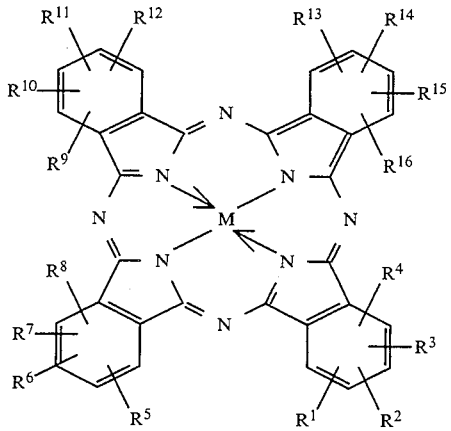

II(b)

wherein M is as defined above; and $R^1$, $R^2$, $R^3$, $R^4$, $R^5$, $R^6$, $R^7$, $R^8$, $R^9$, $R^{10}$, $R^{11}$, $R^{12}$, $R^{13}$, $R^{14}$, $R^{15}$, and $R^{16}$, which may be the same or different, each represent a hydrogen atom, a halogen atom or an electron attractive group, provided that at least one of them represents a halogen atom or an electron attractive group, with the proviso that the ratio of the number of the halogen atom(s) and/or electron attractive group(s) to the total number of the phthalocyanine units in said unsubstituted phthalocyanine compound (A) and said phthalocyanine derivative (B) is from 0.001 to 0.5.

2. An electrophotographic photoreceptor as claimed in claim 1, wherein a weight ratio of said phthalocyanine composition to said binder resin is from 5:95 to 50:50.

3. An electrophotographic photoreceptor as claimed in claim 1, wherein said halogen atom or electron attractive group in said phthalocyanine derivative (B) is a chlorine atom, a bromine atom, a nitro group, a cyano group, a carboxyl group or a sulfo group.

4. An electrophotographic photoreceptor as claimed in claim 1, wherein said phthalocyanine composition comprises 100 parts by weight of said unsubstituted phthalocyanine compound and from 0.001 to 8 parts by weight of the phthalocyanine derivative having 1 to 6 halogen atom(s) and/or electron attractive group(s).

5. An electrophotographic photoreceptor as claimed in claim 1, wherein said phthalocyanine composition comprises 100 parts by weight of said unsubstituted phthalocyanine compound, from 0.001 to 3 parts by weight of the phthalocyanine derivative having 1 to 3 halogen atom(s) and/or electron attractive group(s), and from 0.01 to 8 parts by weight of the phthalocyanine derivative having 4 to 6 halogen atom(s) and/or electron attractive group(s).

6. An electrophotographic photoreceptor as claimed in claim 1, wherein said phthalocyanine composition is a composition obtained by dissolving the unsubstituted phthalocyanine compound and the phthalocyanine derivative in an organic or inorganic acid and adding a poor solvent to the solution to cause precipitation.

7. An electrophotographic photoreceptor as claimed in claim 6, wherein said acid is an organic acid.

8. An electrophotographic photoreceptor as claimed in claim 1, wherein said curable fluorine resin is a copolymer comprising from 25 to 75 mol % of a unit derived from said fluorinated ethylenically unsaturated monomer.

9. An electrophotographic photoreceptor as claimed in claim 1, wherein said ethylenically unsaturated monomer containing no fluorine atom has a group selected from the group consisting of a hydroxyl group, a carboxyl group, an acid anhydride group, an ester group, an amino group, a glycidyl group and a group into which any of these groups can be introduced.

10. An electrophotographic photoreceptor as claimed in claim 1, wherein M in formula (I) or (II) is selected from the group consisting of a hydrogen atom, Cu, Mg, VO and TiO.

* * * * *